US009442432B2

(12) United States Patent
Momose et al.

(10) Patent No.: US 9,442,432 B2
(45) Date of Patent: Sep. 13, 2016

(54) INTERMEDIATE TRANSFER MEMBER AND IMAGE FORMING APPARATUS

(71) Applicants: Ayano Momose, Kanagawa (JP); Akira Izutani, Osaka (JP); Makoto Matsushita, Osaka (JP)

(72) Inventors: Ayano Momose, Kanagawa (JP); Akira Izutani, Osaka (JP); Makoto Matsushita, Osaka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/475,734

(22) Filed: Sep. 3, 2014

(65) Prior Publication Data

US 2015/0078791 A1 Mar. 19, 2015

(30) Foreign Application Priority Data

Sep. 13, 2013 (JP) ..... 2013-191052

(51) Int. Cl.
*G03G 15/01* (2006.01)
*G03G 15/16* (2006.01)

(52) U.S. Cl.
CPC ..... *G03G 15/162* (2013.01)

(58) Field of Classification Search
CPC ..... G03G 15/162
See application file for complete search history.

(56) References Cited

U.S. PATENT DOCUMENTS 5,978,639 A * 11/1999 Masuda et al. ..... 399/302
8,338,066 B2 12/2012 Nozaki et al.
2001/0016531 A1* 8/2001 Morikoshi et al. ..... 474/237
2002/0061210 A1* 5/2002 Ashibe et al. ..... 399/302
2002/0067934 A1* 6/2002 Jia et al. ..... 399/302
2004/0038028 A1* 2/2004 Tanaka ..... D01F 8/10 428/373
2006/0172097 A1* 8/2006 Morikoshi et al. ..... 428/35.7
2006/0226572 A1* 10/2006 Tanaka et al. ..... 264/176.1
2008/0069594 A1 3/2008 Izutani
2008/0069599 A1 3/2008 Nakamura et al.

(Continued)

FOREIGN PATENT DOCUMENTS

JP 2002-202668 7/2002
JP 2006243146 A * 9/2006

(Continued)

OTHER PUBLICATIONS

Machine translation of JP2006243146.*

(Continued)

*Primary Examiner* — David Bolduc
(74) *Attorney, Agent, or Firm* — Cooper & Dunham LLP

(57) ABSTRACT

An intermediate transfer member, including:

a layer containing a thermoplastic resin, an electroconductive resin, and electroconductive inorganic particles, wherein the layer has a sea-island structure where discontinuous phases formed from the electroconductive resin are present in a continuous phase formed from the thermoplastic resin, wherein in a cross-sectional surface of the layer perpendicular to a rotation direction of the intermediate transfer member, the discontinuous phases formed from the electroconductive resin each have a cross-sectional shape of an ellipse, and a minor axis b of the ellipse is from 0.5 μm to 5.0 μm, and wherein in the cross-sectional surface of the layer perpendicular to the rotation direction of the intermediate transfer member, a rate α of a total area of the discontinuous phases formed from the electroconductive resin in an area of the cross-sectional surface thereof is from 2.0% to 20.0%.

6 Claims, 6 Drawing Sheets

(56) References Cited

U.S. PATENT DOCUMENTS

| | | | | |
|---|---|---|---|---|
| 2008/0226997 | A1 | 9/2008 | Nakamura et al. | |
| 2008/0232849 | A1 | 9/2008 | Izutani et al. | |
| 2008/0232864 | A1 | 9/2008 | Izutani et al. | |
| 2009/0060540 | A1 | 3/2009 | Matsushita et al. | |
| 2009/0142107 | A1 | 6/2009 | Akira et al. | |
| 2009/0180791 | A1 | 7/2009 | Matsushita et al. | |
| 2009/0180806 | A1* | 7/2009 | Oshima et al. | 399/176 |
| 2009/0186289 | A1 | 7/2009 | Nakamura et al. | |
| 2009/0190949 | A1 | 7/2009 | Hamahashi et al. | |
| 2009/0238585 | A1 | 9/2009 | Hayashi et al. | |
| 2009/0257792 | A1 | 10/2009 | Nakamura et al. | |
| 2009/0279909 | A1 | 11/2009 | Matsushita et al. | |
| 2009/0324270 | A1 | 12/2009 | Yamashita et al. | |
| 2010/0272481 | A1 | 10/2010 | Yamamoto et al. | |
| 2010/0296848 | A1 | 11/2010 | Yamamoto et al. | |
| 2010/0303520 | A1* | 12/2010 | Miyauchi et al. | 399/320 |
| 2011/0008069 | A1 | 1/2011 | Matsushita et al. | |
| 2011/0013939 | A1* | 1/2011 | Ono | 399/176 |
| 2011/0217653 | A1 | 9/2011 | Izutani et al. | |
| 2011/0249994 | A1 | 10/2011 | Matsushita et al. | |
| 2011/0249995 | A1* | 10/2011 | Uchida et al. | 399/308 |
| 2011/0279546 | A1* | 11/2011 | Kihara | B41J 2/14072 347/50 |
| 2012/0294657 | A1 | 11/2012 | Matsushita et al. | |
| 2013/0216279 | A1* | 8/2013 | Matsunaga | 399/286 |
| 2014/0179864 | A1* | 6/2014 | Saito | B29C 41/18 524/590 |

FOREIGN PATENT DOCUMENTS

| | | | |
|---|---|---|---|
| JP | 4298480 | | 4/2009 |
| JP | 2011-180448 | | 9/2011 |
| JP | 2011-186035 | | 9/2011 |
| JP | 2011-191406 | | 9/2011 |
| JP | 2012018235 | A * | 1/2012 |
| JP | 2012-159737 | | 8/2012 |
| JP | 2012-194229 | | 10/2012 |

OTHER PUBLICATIONS

U.S. Appl. No. 14/185,055, filed Feb. 20, 2014.

* cited by examiner

INTERMEDIATE TRANSFER MEMBER AND IMAGE FORMING APPARATUS

BACKGROUND OF THE INVENTION

1. Field of the Invention

The present invention relates to an intermediate transfer member and an image forming apparatus using the same.

2. Description of the Related Art Known is an intermediate transfer belt for an image forming apparatus, which is produced by using a continuous extrusion molding method advantageous in cost and productivity, which includes at least an electroconductive filler, a thermoplastic resin, and an electroconductive resin incompatible with the thermoplastic resin, and which has a sea-island structure where discontinuous phases formed from the electroconductive resin are present in a continuous phase formed form the thermoplastic resin and the electroconductive filler is dispersed in the continuous phase.

However, the conventional intermediate transfer belt produced by the extrusion method has had many difficulties in ensuring desired electrical properties and desired flame retardancy at the same time. That is, the electroconductive resin added to the intermediate transfer belt for stabilizing its electroconductivity is mostly easily flammable, and there are cases where even if a thermoplastic resin having flame retardancy is used, the resultant intermediate transfer belt does not exhibit sufficient flame retardancy depending on the amount and the dispersion state of the electroconductive resin forming the discontinuous phases. In addition, there has also been a problem that addition of a flame retardant to an intermediate transfer belt elevates cost and involves bleed out of the flame retardant.

Japanese Patent Application Laid-Open Nos. 2011-186035, 2011-191406, and 2002-202668 disclose respectively a seamless belt, a transfer belt, and an endless belt for an image forming apparatus each of which has a sea-island structure. However, any of these literatures has no description about dispersion of the sea-island structure, and has not yet been able to solve the problem with flame retardancy.

SUMMARY OF THE INVENTION

The present invention aims to solve the existing problems pertinent in the art and provide an intermediate transfer member including a layer containing a thermoplastic resin, an electroconductive resin, and electroconductive inorganic particles, and being capable of exhibiting desired electrical properties and desired flame retardancy at the same time.

The above problems are solved by the following invention 1):

1) an intermediate transfer member, including:
   - a layer containing a thermoplastic resin, an electroconductive resin, and electroconductive inorganic particles,
   - wherein the layer has a sea-island structure where discontinuous phases formed from the electroconductive resin are present in a continuous phase formed from the thermoplastic resin,
   - wherein in a cross-sectional surface of the layer perpendicular to a rotation direction of the intermediate transfer member, the discontinuous phases formed from the electroconductive resin each have a cross-sectional shape of an ellipse, and a minor axis b of the ellipse is from 0.5 μm to 5.0 μm, and
   - wherein in the cross-sectional surface of the layer perpendicular to the rotation direction of the intermediate transfer member, a rate α of a total area of the discontinuous phases formed from the electroconductive resin in an area of the cross-sectional surface of the layer perpendicular to the rotation direction of the intermediate transfer member is from 2.0% to 20.0%.

According to the present invention, it is possible to provide an intermediate transfer member including a layer containing a thermoplastic resin, an electroconductive resin, and electroconductive inorganic particles, and being capable of exhibiting desired electrical properties and desired flame retardancy at the same time.

DETAILED DESCRIPTION OF THE INVENTION

Figure 1:
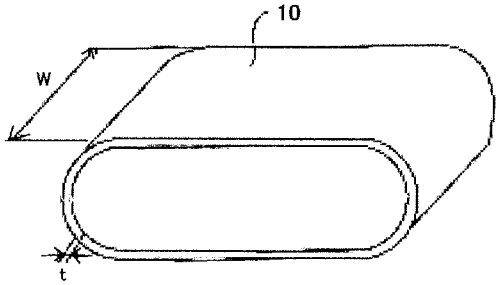
FIG. 1 illustrates one example of an endless intermediate transfer belt of the present invention.

Hereinafter, the present invention 1) will be described in detail, but embodiments of the present invention 1) include the following 2) to 4), which will be described as well.

2) The intermediate transfer member described in 1), wherein in a cross-sectional surface of the layer in the rotation direction of the intermediate transfer member, the discontinuous phases formed from the electroconductive resin each have a cross-sectional shape of a circle, and a diameter e of the circle is from 0.5 μm to 5.0 μm, and
   - wherein in the cross-sectional surface of the layer in the rotation direction of the intermediate transfer member, a rate β of a total area of the discontinuous phases formed from the electroconductive resin in an area of the cross-sectional surface of the layer in the rotation direction of the intermediate transfer member is from 2.0% to 20.0%.

3) The intermediate transfer member described in 1) or 2), wherein the electroconductive resin is a polymer containing a polyether unit.

4) An image forming apparatus, including:

an electrostatic latent image forming unit configured to form an electrostatic latent image on an image bearing member;

a developing unit configured to turn the electrostatic latent image on the image bearing member into a toner image;

a primary transfer unit configured to transfer the toner image on the image bearing member onto an intermediate transfer member;

a secondary transfer unit configured to transfer the primarily transferred toner image onto a recording medium; and a fixing unit configured to fix the secondarily transferred toner image, wherein the intermediate transfer member is the intermediate transfer member according to any one of 1) to 3) above.

The intermediate transfer member of the present invention has a cross-sectional surface having a sea-island structure formed from the thermoplastic resin and the electroconductive resin, and satisfies the above requirement for the present invention 1) to attain desired electrical properties and desired flame retardancy at the same time.

The sea-island structure in the present invention is the same as the above-described conventional art in that discontinuous phases formed from the electroconductive resin are present in a continuous phase formed from the thermoplastic resin. However, the dispersion state of the electroconductive resin corresponding to the island is different from the conventional art, and the present invention is defined about this different point in terms of a cross-sectional state thereof.

The sea-island structure in the present invention cannot be obtained by using a combination of a thermoplastic resin and an electroconductive resin incompatible with the thermoplastic resin as in the above conventional techniques. It is necessary to select a proper combination of resins considering compatibility between the thermoplastic resin and the electroconductive resin. For example, when the thermoplastic resin and the electroconductive resin are selected so that the difference in solubility parameter (SP value) therebetween is 2.5 or more, and these resins are used to produce an intermediate transfer member by a twin screw extruder with a rotation speed set to be from 10 rpm to 40 rpm, the thus-produced intermediate transfer member can have an intended surface resistivity $\rho S$ of $8 \leq \log \rho S \leq 13$, which has been difficult to control by conventional techniques.

Examples of the thermoplastic resin used in the present invention include homopolymers of vinylidene fluoride, copolymers formed between vinylidene fluoride and other monomers, polyethylene-tetrafluoroethylene resins (ETFE), vinylidene fluoride-tetrafluoroethylene copolymer resins (PVDF-ETFE), polychlorotrifluoroethylene (PCTFE), tetrafluoroethylene-hexafluoropropylene copolymers (FEP), a tetrafluoroethylene resin, and perfluoroalkylvinylether copolymers (PFA).

Examples of the electroconductive resin used in the present invention include polyethers, polyesters, polyamides, polyimides, polyethyleneglycols, polyethyleneoxides, polyacrylates, polymethacrylates, and polymers each containing, as a main structural unit, a copolymer having two or more kinds of structures selected from the foregoing. Among these, polymers having a polyether unit are preferable. A SP value of the electroconductive resin is preferably within the range of from 7 to 11.

Examples of the electroconductive inorganic particles used in the present invention include carbon black, graphite, natural graphite, artificial graphite, tin oxide, titanium oxide, zinc oxide, nickel, and copper.

An average primary particle diameter of the electroconductive inorganic particles is preferably from 5 nm to 50 nm.

Examples of the intermediate transfer member of the present invention include an endless intermediate transfer belt, and an intermediate transfer drum.

FIG. 1 illustrates one example of an endless intermediate transfer belt which is one example of the intermediate transfer member of the present invention.

The endless intermediate transfer belt 10 has flexibility and is freely deformable. FIG. 1 illustrates a state in which the endless intermediate transfer belt 10 is bridged around two rollers. A dimension of the endless intermediate transfer belt 10 is generally from about 100 mm to about 300 mm in outer diameter when it is formed to have a cylindrical shape, from about 100 mm to about 300 mm in width (W), and from about 50 μm to about 200 μm in thickness (T).

Figure 2:
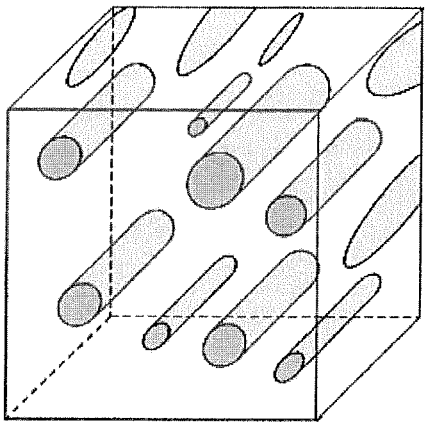
FIG. 2 is a schematic view (partially enlarged view) illustrating an inner structure of the endless intermediate transfer belt of FIG. 1.

FIG. 2 is a schematic view (partially enlarged view) illustrating an inner structure of the endless intermediate transfer belt 10 of FIG. 1.

In a usual case, when the endless intermediate transfer belt is molded through continuous extrusion molding, spherical particles of the electroconductive resin dispersed are extended in parallel with the extrusion direction (i.e., in a perpendicular direction to the rotation direction of the endless intermediate transfer belt) at the time the materials having passed through a kneader are extruded to pass through a mold, and as a result the spherical particles of the electroconductive resin turn into elliptical particles. Hence, when the endless intermediate transfer belt is cut along the rotation direction of the endless intermediate transfer belt, each of the cross-sectional surfaces of the particles of the electroconductive resin is observed to be circular, and when the endless intermediate transfer belt is cut along a perpendicular direction to the rotation direction of the endless intermediate transfer belt, each of the cross-sectional surfaces of the particles of the electroconductive resin is observed to be elliptical. The sea-island structure in the endless intermediate transfer belt of the present invention produced through molding does not come to be in a geographically uniform state, nor do the shapes of the islands come to be geographically constant. Therefore, the terms "ellipse" and "elliptical" used in the present specification and the claims each refer to not only an ellipse in a literal sense, but also to a substantially elliptical shape that is near to an ellipse but has distortion. Similarly, the terms "circle" and "circular" used in the present specification and the claims each refer to not only a circle in a literal sense, but also to a substantially circular shape that is near to a circle but has distortion.

Here, the rotation direction of the intermediate transfer belt can also be expressed as a direction in which the surface of the intermediate transfer belt moves.

Figure 3:
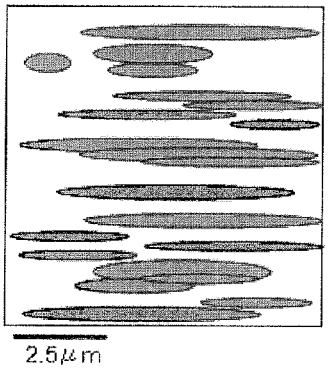
FIG. 3 is an enlarged schematic view of one example of a cross-sectional surface of an endless intermediate transfer belt of the present invention, where the cross-sectional surface is perpendicular to a rotation direction of the endless intermediate transfer belt.

FIG. 3 is an enlarged schematic view of one example of a cross-sectional surface of an endless intermediate transfer belt of the present invention, where the cross-sectional surface is perpendicular to the rotation direction of the endless intermediate transfer belt.

When the endless intermediate transfer belt is cooled with liquid nitrogen and then cut along a surface perpendicular to the rotation direction thereof to expose its cross-sectional surface, and the resultant is subjected to electron staining using an appropriate staining agent such as ruthenium tetraoxide and observed as a backscattered electron image (compositional image) with a scanning electron microscope, it is possible to confirm the electroconductive resin as stained portions in the thermoplastic resin forming a continuous phase, as illustrated in FIG. 3. It is possible to observe that the cross-sectional surfaces of the electroconductive resin are substantially elliptical and also that the minor axis b thereof is from 0.5 μm to 5.0 μm and the expression: $1<a/b\leq 30$ (where "a" denotes the major axis thereof) is satisfied. Moreover, when image processing software is used to calculate α rate α of a total area of discontinuous phases formed from the electroconductive resin in an area of the cross-sectional surface of the intermediate transfer member cut along the direction perpendicular to the rotation direction of the intermediate transfer member, the rate α is from 2.0% to 20.0%.

Figure 4:
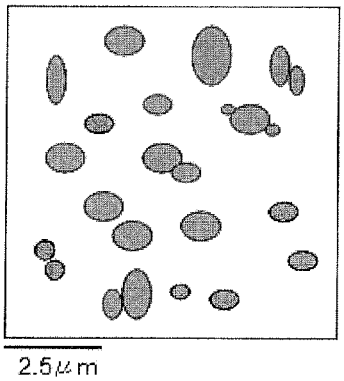
FIG. 4 is an enlarged schematic view of one example of a cross-sectional surface of an endless intermediate transfer belt of the present invention, where the cross-sectional surface is cut along in a rotation direction of the endless intermediate transfer belt.

FIG. 4 is an enlarged schematic view of one example of a cross-sectional surface of an endless intermediate transfer belt of the present invention, where the cross-sectional surface is cut along the rotation direction of the endless intermediate transfer belt.

When the endless intermediate transfer belt is cooled with liquid nitrogen and then cut along the rotation direction thereof to expose its cross-sectional surface, and the resultant is subjected to electron staining using an appropriate staining agent such as ruthenium tetraoxide and observed as a backscattered electron image (compositional image) with a scanning electron microscope, it is possible to confirm a state where the electroconductive resin in the thermoplastic resin forming a continuous phase is dispersed to form a heterogeneous phase, as illustrated in FIG. 4. The cross-sectional surfaces of the electroconductive resin are substantially circular, and the diameter thereof is from 0.5 μm to 5.0 μm. Moreover, when image processing software is used to calculate a rate β of a total area of discontinuous phases formed from the electroconductive resin in an area of the cross-sectional surface of the intermediate transfer member cut along the rotation direction of the intermediate transfer member, the rate β is from 2.0% to 20.0%.

Figure 5A:
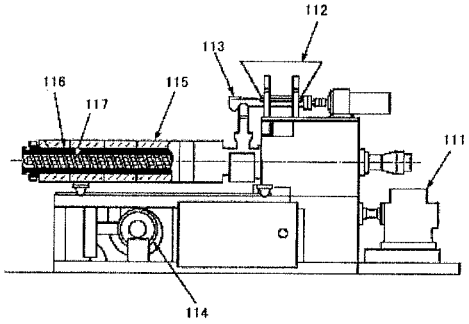
FIG. 5A illustrates one example of an extruder used for extruding materials of an endless intermediate transfer belt of the present invention.
Figure 5B:
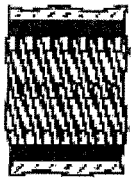
FIG. 5B illustrates a partial plan view of a twin screw in the extruder illustrated in FIG. 5A.

FIGS. 5A and 5B illustrate an example of an extruder used for extruding materials of the endless intermediate transfer belt of the present invention.

FIG. 5A illustrates a twin screw-type extruder. Here, a screw-meshing type is preferable to a non-screw-meshing type since larger effects of kneading materials can be obtained in the screw-meshing type. Moreover, a counter-rotating screw type is more preferable since still larger effects of kneading materials can be obtained. The twin screw-type extruder illustrated in FIG. 5A has a motor 111, a hopper 112, a feeder 113, a blower 114, a heater 115, a cylinder 116, and a twin screw 117.

Figure 6:
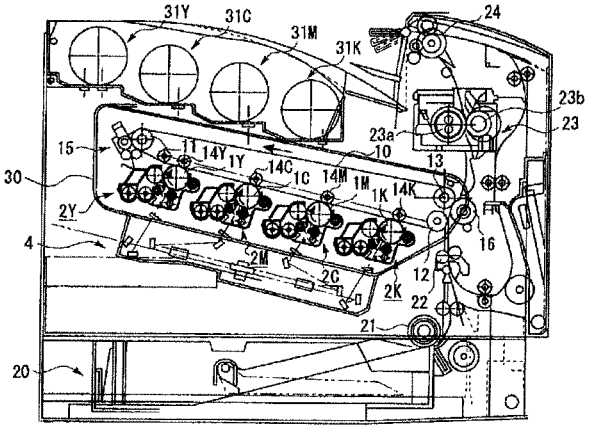
FIG. 6 is a schematic cross-sectional view illustrating one example of an image forming apparatus of the present invention.

FIG. 6 is a schematic cross-sectional view illustrating one example of an image forming apparatus of the present invention. The image forming apparatus employs an electrophotographic method, forming color images from four color toners which are yellow (Y), cyan (C), magenta (M), and black (K) toners.

First, description will be given to a basic configuration of an image forming apparatus (tandem-type image forming apparatus) including a plurality of latent image bearing members arranged along a direction in which a surface-moving member moves.

The image forming apparatus has four photoconductors 1Y, 1C, 1M, and 1K as the latent image bearing members. Although a drum-shape photoconductor is employed in FIG. 6, a belt-shape photoconductor may be employed as well.

The photoconductors 1Y, 1C, 1M, and 1K are driven to rotate in the arrow direction in FIG. 6 while contacting the endless intermediate transfer belt 10 which is the surface-moving member. Each of the photoconductors 1Y, 1C, 1M, and 1K is composed of a relatively thin cylindrical electroconductive substrate, a photoconductive layer formed thereon, and a protective layer formed on the photoconductive layer. Here, an intermediate layer may be provided between the photoconductive layer and the protective layer.

Figure 7:
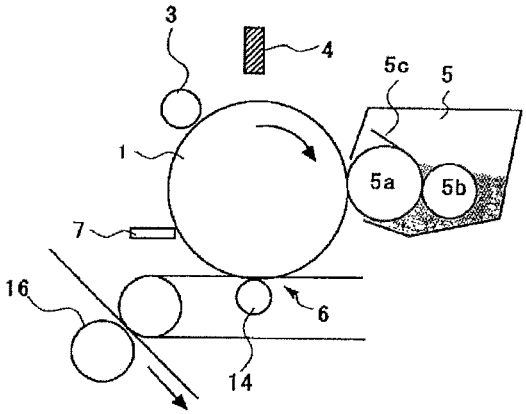
FIG. 7 is a schematic cross-sectional view illustrating one example of an image forming part in which a photoconductor is disposed.

FIG. 7 is a schematic cross-sectional view illustrating one example of an image forming part in which a photoconductor is disposed. Note that, since the configurations around the photoconductors 1Y, 1C, 1M, and 1K are the same in image forming parts 2Y, 2C, 2M, and 2K, only one image forming part is illustrated, and symbols for indicating color; i.e., Y, C, M, or K, are omitted.

A charging device 3, a developing device 5, a transfer device 6, and a cleaning device 7 are disposed around the photoconductor 1 in this order along the direction in which the surface of the photoconductor 1 moves. The charging device 3 serves as a charging unit. The developing device 5 serves as a developing unit. The transfer device 6 serves as a transfer unit configured to transfer a toner image on the photoconductor 1 onto a recording medium or the endless intermediate transfer belt 10. The cleaning device 7 is configured to remove the un-transferred toner remaining on the photoconductor 1. A space is secured between the charging device 3 and the developing device 5 so that light emitted from an exposing device 4, which serves as an exposing unit configured to write an electrostatic latent image, can reach the photoconductor 1.

The charging device 3 is for negatively charging the surface of the photoconductor 1. In this example, the charging device 3 is equipped with a charging roller serving as a charging member which performs charging treatment by a so-called contact/close charging method. That is, the charging device 3 makes the charging roller contact with or close to the surface of the photoconductor 1, and applies negative bias to the charging roller to charge the surface of the photoconductor 1. Specifically, the charging device 3 applies DC charging bias to the charging roller so that the surface potential of the photoconductor 1 becomes −500 V. The charging bias may be one obtained by superposing AC bias on DC bias. Moreover, the charging device 3 may be equipped with a cleaning brush which cleans the surface of the changing roller.

Note that, the charging device 3 may be one obtained by winding a thin film around both end portions on the circumferential surface of a charging roller in the axial direction thereof, and this may be disposed so as to contact the surface of the photoconductor 1. In the case of this configuration, the surface of the charging roller and the surface of the photoconductor 1 are apart from each other by only the thickness of the film, which is a state where the surface of the charging roller is very close to and the surface of the photoconductor 1. In this state, charging bias applied to the charging roller generates electrical discharge between the surface of the charging roller and the surface of the photoconductor 1, so that the surface of the photoconductor 1 is charged by the generated electrical discharge.

The surface of the photoconductor 1 charged in this manner is exposed to light by the exposing device 4 to have an electrostatic latent image corresponding to each color. The exposing device 4 writes an electrostatic latent image corresponding to each color on the photoconductor 1 according to image information corresponding to each color.

Note that, in this example, the exposing device 4 employs a laser method, but may employ another method using an LED array and an imaging unit.

A toner replenished from a toner bottle 31Y, 31C, 31M, or 31K to the developing device 5 is conveyed by a developer supply roller 5*b* and born on a developing roller 5*a*. The developing roller 5*a* is rotated to a developing region facing the photoconductor 1. In a region facing the photoconductor 1 (hereinafter referred to as "developing region"), the surface of the developing roller 5*a* moves at a higher linear velocity than that of the surface of the photoconductor 1 in the same direction as the photoconductor 1 moves. The toner on the developing roller 5*a* is supplied to the surface of the photoconductor 1 while the developing roller 5*a* is sliding on the surface of the photoconductor 1. At this time, a developing bias of −300 V is applied to the developing roller 5*a* from an unillustrated power source, whereby a developing electric field is formed in the developing region. Between the developing roller 5*a* and the electrostatic latent image on the photoconductor 1, the toner on the developing roller 5*a* will receive such an electrostatic force as to direct the toner toward the electrostatic latent image. This electrostatic force allows the toner on the developing roller 5*a* to adhere to the electrostatic latent image on the photoconductor 1. By this adhesion, the electrostatic latent image on the photoconductor 1 is developed to be a toner image corresponding to each color.

The endless intermediate transfer belt 10 in the transfer device 6 is wound around three support rollers 11, 12, and 13 in a stretched manner, and is configured to rotate in the arrow direction in the figure. Toner images on the photoconductors 1Y, 1C, 1M, and 1K are transferred onto the endless intermediate transfer belt 10 on top of each other by an electrostatic transfer method.

The electrostatic transfer method used here employs a transfer roller 14 involving generation of less transfer dust particles, although a transfer charger may be employed. Specifically, primary transfer rollers 14Y, 14C, 14M, and 14K, each serving as a transfer device 6, are disposed on the rear surfaces of contact portions of the endless intermediate transfer belt with the photoconductors 1Y, 1C, 1M, and 1K. As a result, primary transfer nip portions are formed between the photoconductors 1Y, 1C, 1M, and 1K and portions of the endless intermediate transfer belt 10 which are pressed by the primary transfer rollers 14Y, 14C, 14M, and 14K. When the toner images on the photoconductors 1Y, 1C, 1M, and 1K are transferred onto the endless intermediate transfer belt 10, positive bias is applied to each of the primary transfer rollers 14. As a result, a transfer electric field is formed in each of the transfer nip portions, and the toner images on the photoconductors 1Y, 1C, 1M, and 1K are deposited electrostatically on and transferred onto the endless intermediate transfer belt 10.

An intermediate transfer belt cleaning device 15 is provided around the endless intermediate transfer belt 10 in order to remove toner particles remaining on the surface thereof. The intermediate transfer belt cleaning device 15 is configured to use a fur blush and a cleaning blade to collect unnecessary toner particles deposited on the surface of the endless intermediate transfer belt 10.

Note that, the collected unnecessary toner particles are conveyed from the intermediate transfer belt cleaning device 15 to a waste toner tank by an unillustrated conveyance unit.

A secondary transfer roller 16 is disposed to be in contact with the endless intermediate transfer belt 10 at a part of the endless intermediate transfer belt 10 around the support roller 13. A secondary transfer nip portion is formed between the endless intermediate transfer belt 10 and the secondary transfer roller 16, receiving sheets of recording paper serving as a recoding member at a predetermined timing. The sheets of recording paper are housed in a paper feeding cassette 20 located below the exposing device 4 in the figure, and are conveyed to the secondary transfer nip portion by, for example, a paper feeding roller 21 and a pair of registration rollers 22. The toner images superposed on top of each other on the endless intermediate transfer belt 10 are transferred onto the sheet of recording paper at one time in the secondary nip portion.

At the time of this secondary transfer, positive bias is applied to the secondary transfer roller 16, and the thus-generated transfer electrical field allows the toner images on the endless intermediate transfer belt 10 to be transferred onto the sheet of recording paper.

In the case where the toner image formed on the photoconductor 1 is transferred onto the endless intermediate transfer belt 10, it is preferable that the photoconductor 1 and the endless intermediate transfer belt 10 be pressed against each other. The pressure force for this is preferably from 10 N/m to 60 N/m.

A heat-fixing device 23 serving as a fixing unit is disposed downstream of the secondary transfer nip portion in the conveyance direction of the sheets of recording paper. The heat-fixing device 23 has a heating roller 23*a* with a built-in heater and a pressure roller 23*b* for applying pressure.

The sheet of recording paper having passed through the secondary transfer nip portion is sandwiched between these rollers to receive heat and pressure. As a result, the toner particles on the sheet of recording paper melt, and a toner image is fixed on the sheets of recording paper. After this fixing, the sheet of recording paper is discharged by a discharge roller 24 to a discharge tray disposed on the upper surface of the apparatus.

The developing roller 5*a* serving as a developer bearing member is partially exposed from the opening of a casing of the developing device 5. Also, the developer used here is a one-component developer containing no carrier. The developing device 5 contains each of the corresponding color toners therein which have been replenished from toner bottles 31Y, 31C, 31M, and 31K illustrated in FIG. 6. The toner bottle 31Y, 31C, 31M, or 31K is configured to be attachable to and detachable from the body of an image forming apparatus so that each of the bottles can be replaced alone. This configuration can reduce users' expenditure since only the toner bottle 31Y, 31C, 31M, or 31K may be replaced at the time the toner is used up, and the other constituent members with service life remaining at that time can be used as they are.

Figure 8:
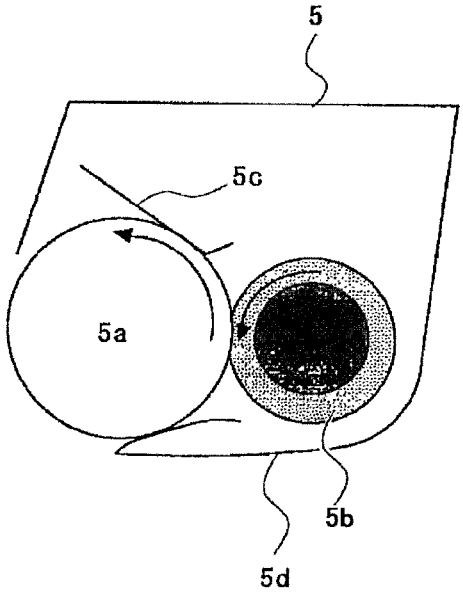
FIG. 8 is a schematic cross-sectional view illustrating one example of a developing device.

FIG. 8 is a schematic cross-sectional view illustrating one example of a developing device.

While being stirred by the supply roller 5*b* serving as a developer supplying member, a developer (toner) in a developer container is conveyed to a nip portion in the developing roller 5*a* serving as a developer bearing member which bears, on its surface, the developer to be supplied to the photoconductor 1. At this time, the supply roller 5*b* and the developing roller 5*a* rotate in opposite directions (counter rotation) in the nip portion. Moreover, the amount of the toner on the developing roller 5*a* is regulated by a regulating blade 5*c*, which serves as a developer layer regulating member disposed so as to contact the developing roller 5*a*, and a toner thin layer is formed on the developing roller 5*a*.

Also, the developer is rubbed in the nip portion between the supply roller 5*b* and the developing roller 5*a*, and in between the regulating blade 5*c* and the developing roller 5*a*, so that the amount of charges of the developer is controlled appropriately.

Figure 9:
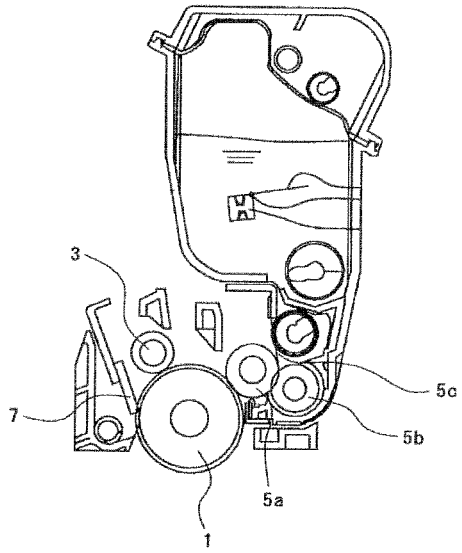
FIG. 9 is a schematic cross-sectional view illustrating one example of a process cartridge.

FIG. 9 is a schematic cross-sectional view illustrating one example of a process cartridge.

In general, among constituent elements such as an electrostatic latent image bearing member, an electrostatic latent image charging unit, and a developing unit, two or more of them are united together as a process cartridge. This process cartridge is configured to be attachable to and detachable from the main body of an image forming apparatus such as a copier or a printer.

The process cartridge illustrated in FIG. 9 has an electrostatic latent image bearing member, an electrostatic latent image charging unit, and the developing unit described in FIG. 8.

Figure 10:
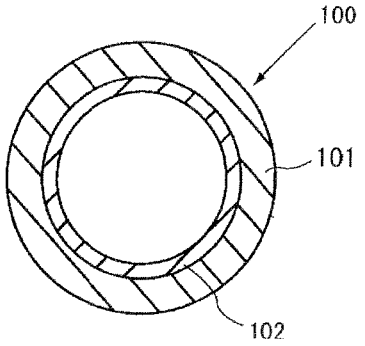
FIG. 10 illustrates a common structure of an intermediate transfer drum.

The above describes the case of the endless intermediate transfer belt, but applies also to the case of an intermediate transfer drum. However, as illustrated in FIG. 10, a general intermediate transfer drum 100 has a structure in which a semiconductive layer 101 is laminated on a cylindrical electroconductive base material 102, and hence this semimconductive layer is formed from the same materials to have the same structure as in the endless intermediate transfer belt.

EXAMPLES

The present invention will next be described in more detail by way of Examples and Comparative Examples. However, the present invention should not be construed by being limited to the Examples. In Examples, the unit "part(s)" means "part(s) by mass".

[Synthesis of Electroconductive Resins (1) to (4) Having a Polyether Unit]

<Electroconductive Resin (1)>

Synthesis of Maleic Anhydride-Modified Polypropylene

A glass container was charged with 800 parts of polypropylene, 320 parts of maleic anhydride, and 80 parts of xylene. After the resultant mixture had been stirred at 120° C. to prepare a homogeneous solution, 40 parts of benzoyl peroxide dissolved in a small amount of xylene was added dropwise into the solution. The resultant mixture was allowed to react at 120° C. for 6 hours. After completion of reaction, a polymer was allowed to precipitate in acetone, followed by filtration and drying, to thereby obtain powder of maleic anhydride-modified polypropylene.

Synthesis of Electroconductive Resin (1)

An autoclave made of stainless steel was charged with 60 parts of the above-obtained maleic anhydride-modified polypropylene, 33 parts of polyethylene glycol (202444, product of Sigma-Aldrich Co., Mn: 3,350), and 0.5 parts of zirconyl acetate. These materials were polymerized for 4 hours at 230° C. and 1 mmHg or less to obtain electroconductive resin (1) which is a block polymer. The electroconductive resin (1) was found to have a Mn (number average molecular weight) of 27,000.

<Electroconductive Resin (2)>

An autoclave made of stainless steel was charged with 60 parts of a polyhydroxy polyolefin oligomer (POLYTAIL, product of Mitsubishi Chemical Corporation, Mn: 2,000), 33 parts of polyethylene glycol (202444, product of Sigma-Aldrich Co., Mn: 3,350), and 0.5 parts of zirconyl acetate. These materials were polymerized for 4 hours at 230° C. and 1 mmHg or less to obtain electroconductive resin (2) which is a block polymer. The electroconductive resin (2) was found to have a Mn of 26,500.

<Electroconductive Resin (3)>

A 4-neck flask equipped with a stirrer, a thermometer, a Dimroth condenser, and a nitrogen gas-introducing tube was charged with 200 parts of toluene, 100 parts of isopropyl alcohol, and 100 parts of hydroxylated polypropylene "POLYTAIL (registered trademark), product of Mitsubishi Chemical Corporation" (hydroxyl value: 45 mg/g) and the material was dissolved at 70° C. Next, 13.5 parts of hexamethylenediisocyanate (molecular weight: 168) was added to the flask, and the resultant mixture was allowed to react for 5 hours at 70° C. while nitrogen gas was being introduced into the flask. Into the flask, 25 parts of polyethylene glycol (PEG#1500, product of Lion Corporation, hydroxyl value: 187 to 224) was added, and the mixture was allowed to react for 10 hours. Then, toluene was removed by an evaporator to thereby obtain electroconductive resin (3) which is a polyolefin-polyethylene glycol block polymer having a urethane bond. The electroconductive resin (3) was found to have a Mn of 23,500.

<Electroconductive Resin (4)>

At 200° C. in an atmosphere of nitrogen gas, 66 parts of the above maleic anhydride-modified polypropylene obtained in the synthesis of the electroconductive resin (1), and 34 parts of 12-aminolauric acid (product of Tokyo Chemical Industry Co., Ltd.) were melted, and the mixture was allowed to react for 3 hours at 200° C. and 10 mmHg or less to obtain a polypropylene modified with 12-aminolauric acid (modified polypropylene).

Next, 60 parts of the above-obtained modified polypropylene, 33 parts of polyethylene glycol (202444, product of Sigma-Aldrich, Mn: 3,350), 7 parts of sodium dodecylbenzensulfonate, 0.3 parts of an antioxidant (IRGANOX 1010, product of BASF Japan Ltd.) and 0.5 parts of zirconyl acetate were mixed and polymerized for 4 hours at 230° C. and 1 mmHg or less to thereby obtain electroconductive resin (4). The electroconductive resin (4) was found to have a Mn of 27.900.

[Synthesis of Electroconductive Resin (5) Having No Polyether Unit]

<Electroconductive Resin (5)>

A container was charged with 54 parts of anhydrous ϵ-caprolactam (product of Ube Industries, Ltd.) and 22 parts of ϵ-caprolactone (product of Daicel Corporation), followed by heating to 140° C. to 150° C. Then, 1.8 g of hexamethylenediisocyanate (product of Tokyo Chemical Industry Co., Ltd.) which is a promoter for polymerization, was added and mixed. The other container was charged with 20 parts of anhydrous ϵ-caprolactam. Subsequently, 0.082 parts of sodium hydride (product of Tokyo Chemical Industry Co., Ltd., oiliness: 63% by mass) which is a polymerization catalyst was added to this container, and the temperature of the mixture was adjusted to a range from 140° C. to 150° C. These two liquids were mixed together, followed by polymerization for 30 minutes at 155° C., to thereby obtain electroconductive resin (5). The electroconductive resin (5) was found to have a Mn of 12,000.

[Measurement of Melting Point of Electroconductive Resins (1) to (5)]

Each of the above-obtained electroconductive resins (1) to (5) was subjected to differential scanning colorimetry (DSC) using SEIKO DSC200U SYSTEM (product of Seiko Instruments Inc.).

First, a sample was heated from −100° C. to 300° C. at a heating rate of 20° C./min in a nitrogen atmosphere. Next, the sample was gradually cooled, and thereafter the sample was heated again from −100° C. to 300° C. at a heating rate of 10° C./min under a nitrogen atmosphere similarly. A melting point (Tm) was defined as a peak top of an endothermic profile with melting in a DSC scanning diagram obtained in the second heating procedure. As a result, all of the melting points of the electroconductive resins (1) to (5) were observed at a temperature from 30° C. to 60° C.

Example 1

Preparation of Resin Pellets 1

Into a twin kneader (L/D=40), 86 parts of polyvinylidene fluoride (KYNAR720, product of ARKEMA K.K., melting point: 168° C.) which is a thermoplastic resin, and 9 parts of carbon black (DENKA BLACK, product of DENKI KAGAKU KOGYO K.K.) as electroconductive inorganic particles were charged. The mixture was melt-kneaded at 180° C. to prepare resin pellets 1.

[Molding of Endless Intermediate Transfer Belt]

The resin pellets 1 were charged into a hopper part of a twin extrusion molding apparatus (L/D=40). While the electroconductive resin was being added to the resin pallets 1 from a side feeder of the apparatus, the mixture was kneaded and extruded from a circular die of the apparatus which is 200 mm in diameter. A kneading speed was set to 30 rpm. The temperature of a cylinder having the side feeder was set to 180° C., and the temperature of the circular die was set to 200° C. Under these conditions, an endless intermediate transfer belt having a thickness of 100 μm was molded. The amount of the electroconductive resin (1) added was adjusted to 5% by mass of the whole material.

Example 2

Molding of Endless Intermediate Transfer Belt

An endless intermediate transfer belt having a thickness of 100 μm was molded in the same manner as in Example 1 except that the electroconductive resin (1) was changed to the electroconductive resin (2).

Example 3

Molding of Endless Intermediate Transfer Belt

An endless intermediate transfer belt having a thickness of 100 μm was molded in the same manner as in Example 1 except that the electroconductive resin (1) was changed to the electroconductive resin (3).

Example 4

Molding of Endless Intermediate Transfer Belt

An endless intermediate transfer belt having a thickness of 100 μm was molded in the same manner as in Example 1 except that the electroconductive resin (1) was changed to the electroconductive resin (4) and the amount of the electroconductive resin added was changed to 3% by mass.

Example 5

Molding of Endless Intermediate Transfer Belt

An endless intermediate transfer belt having a thickness of 100 μm was molded in the same manner as in Example 1 except that the electroconductive resin (1) was changed to the electroconductive resin (4).

Example 6

Preparation of Resin Pellets 2

Into a twin kneader (L/D=40), 86 parts of a copolymer of polyvinylidene fluoride (SOLEF FLEX VISC. 10, product of Solvayplastics, melting point: 160° C.) which is a thermoplastic resin and 9 parts of carbon black (DENKA BLACK, product of DENKI KAGAKU KOGYO K.K.) as electroconductive inorganic particles were charged. The mixture was melt-kneaded at 180° C. and 30 rpm to prepare resin pellets 2.

[Molding of Endless Intermediate Transfer Belt]

The resin pellets 2 were charged into a hopper part of a twin extrusion molding apparatus (L/D=40). While the electroconductive resin (1) was being added to the resin pellets 2 from the side feeder of the apparatus, the mixture was kneaded and extruded from a circular die of the apparatus which is 200 mm in diameter. A kneading speed was set to 30 rpm. The temperature of a cylinder having the side feeder was set to 180° C., and the temperature of the circular die was set to 200° C. Under these conditions, an endless intermediate transfer belt having a thickness of 100 μm was molded. The amount of the electroconductive resin (1) added was adjusted to 5% by mass of the whole material.

Example 7

Molding of Endless Intermediate Transfer Belt

An endless intermediate transfer belt having a thickness of 100 μm was molded in the same manner as in Example 6 except that the electroconductive resin (1) was changed to the electroconductive resin (2).

Example 8

Molding of Endless Intermediate Transfer Belt

An endless intermediate transfer belt having a thickness of 100 μm was molded in the same manner as in Example 6 except that the electroconductive resin (1) was changed to the electroconductive resin (3).

Example 9

Molding of Endless Intermediate Transfer Belt

An endless intermediate transfer belt having a thickness of 100 μm was molded in the same manner as in Example 6 except that the electroconductive resin (1) was changed to the electroconductive resin (4) and the amount of the electroconductive resin added was changed to 3% by mass.

Example 10

Molding of Endless Intermediate Transfer Belt

An endless intermediate transfer belt having a thickness of 100 μm was molded in the same manner as in Example 6 except that the electroconductive resin (1) was changed to the electroconductive resin (4).

Example 11

Molding of Endless Intermediate Transfer Belt

An endless intermediate transfer belt having a thickness of 100 μm was molded in the same manner as in Example 1 except that the kneading speed in the molding of the endless intermediate transfer belt was changed to 15 rpm.

Example 12

Molding of Endless Intermediate Transfer Belt

An endless intermediate transfer belt having a thickness of 100 μm was molded in the same manner as in Example 11 except that the electroconductive resin (1) was changed to the electroconductive resin (2).

Example 13

Molding of Endless Intermediate Transfer Belt

An endless intermediate transfer belt was molded in the same manner as in Example 11 except that the electroconductive resin (1) was changed to the electroconductive resin (3).

Example 14

Molding of Endless Intermediate Transfer Belt

An endless intermediate transfer belt having a thickness of 100 μm was molded in the same manner as in Example 11 except that the electroconductive resin (1) was changed to the electroconductive resin (4) and the amount of the electroconductive resin (4) added was changed to 3% by mass.

Example 15

Molding of Endless Intermediate Transfer Belt

An endless intermediate transfer belt having a thickness of 100 μm was molded in the same manner as in Example 11 except that the electroconductive resin (1) was changed to the electroconductive resin (4).

Example 16

Preparation of Resin Pellets 3

Into a twin kneader (L/D=40), 81 parts of polyvinylidene fluoride (KYNAR720, product of ARKEMA JAPAN K.K., melting point: 168° C.) which is a thermoplastic resin was charged. This material was melt-kneaded at 180° C. and 30 rpm to prepare resin pellets 3.

[Molding of Endless Intermediate Transfer Belt]

An endless intermediate transfer belt having a thickness of 100 μm was molded in the same manner as in Example 1 except that the resin pellets 1 were changed to the resin pellets 3, and the amount of the electroconductive resin (1) added was adjusted to 10% by mass of the whole material.

Example 17

Molding of Endless Intermediate Transfer Belt

An endless intermediate transfer belt having a thickness of 100 μm was molded in the same manner as in Example 16 except that the electroconductive resin (1) was changed to the electroconductive resin (2).

Example 18

Molding of Endless Intermediate Transfer Belt

An endless intermediate transfer belt having a thickness of 100 μm was molded in the same manner as in Example 16 except that the electroconductive resin (1) was changed to the electroconductive resin (3).

Example 19

Molding of Endless Intermediate Transfer Belt

An endless intermediate transfer belt having a thickness of 100 μm was molded in the same manner as in Example 16 except that the electroconductive resin (1) was changed to the electroconductive resin (4) and the amount of the electroconductive resin added was changed to 6% by mass.

Example 20

Molding of Endless Intermediate Transfer Belt

An endless intermediate transfer belt having a thickness of 100 μm was molded in the same manner as in Example 16 except that the electroconductive resin (1) was changed to the electroconductive resin (4).

Example 21

Molding of Endless Intermediate Transfer Belt

An endless intermediate transfer belt having a thickness of 100 μm was molded in the same manner as in Example 1 except that DENKA BLACK was changed to KETJEN BLACK (product of Lion Corporation) and the amount thereof was changed to 4% by mass.

Example 22

Molding of Endless Intermediate Transfer Belt

An endless intermediate transfer belt having a thickness of 100 μm was molded in the same manner as in Example 16 except that the electroconductive resin (1) was changed to the electroconductive resin (5) and the amount of DENKA BLACK added was changed to 4% by mass.

Various properties of the endless intermediate transfer belts of the above Examples were evaluated in the following manner. The results are collectively shown in Tables 1 to 4. The units of the numerical values in the columns for the materials in the tables are % by mass.

[Localized State of Electroconductive Resin]

A cross-sectional surface of the endless intermediate transfer belt was analyzed with a scanning electron microscope (SEM) (S-4800, product of Hitachi High-Technologies Corporation). In addition, elemental analysis of the cross-sectional surface was performed with an energy dispersive X-ray analyzer (EDS) (an energy dispersive X-ray analyzer, product of EDAX Co.) to determine whether the electroconductive resin was localized or not.

A microtome (product of Leica Co.) was employed for preparation of samples of cross-sectional surfaces. The measurement results obtained using the SEM and the EDS were processed using image processing software "IMAGE J" to calculate α rate of the electroconductive resin in the cross-sectional surface of the layer.

Here, "being localized" is a feature of a belt having desired electrical characteristics. A cross-sectional surface of such a belt is observed as a state where dispersed electroconductive resin particles are aggregated in the resin serving as a main component of the belt and are present in the form of a sea-island structure to form electroconductive paths. In contrast, "being uniformly dispersed" is a feature of a belt that does not exhibit desired electrical characteristics. Since the resin serving as a main component is uniformly compatible with an electroconductive resin, there are not electroconductive paths in the belt. In the present invention, a state of "being localized" is preferable.

[Resistivity]

Resistivity of the endless intermediate transfer belt was measured using HIRESTA UP MCP-HT450 model (product of Mitsubishi Chemical Analutech Co, Ltd.). Specifically, surface resistivity was measured at a plurality of measurement points of the endless intermediate transfer belt after application of voltage at 10 V or 500 V for 10 seconds, and the measurements were averaged to calculate an average, which was used as the surface resistivity. Volume resistivity was measured at a plurality of measurement points of the endless intermediate transfer belt after application of voltage at 100 V or 250 V for 10 seconds, and the measurements were averaged to calculate an average, which was used as the volume resistivity.

The surface resistivity and the volume resistivity falling within a range from $1.00\times10^{8}$ to $9.99\times10^{13}$ are regarded as pass. In Tables 5-1 and 5-2, the term "OVER" means that the surface resistivity or the volume resistivity is higher than $1.00\times10^{14}$, and the term "UNDER" means that the surface resistivity or the volume resistivity is lower than $9.99\times10^{7}$.

[Flame Retardancy]

A flammability test was performed according to the UL94 Standard. After applied ten and several times to a central part of the lower end of a specimen, a 6-inch-flame was taken away from the specimen. A burning time of the specimen was measured. Immediately after putting out the flame, a flame was applied again to the specimen for 20 seconds, and taken away from the specimen. A burning time, a glowing time, and the presence or absence of ignition of surgical cotton placed 12 inch below were recorded and judged.

Note that, the flame retardancy according to the UL94 Standard is ranked UL94V-2, UL94V-1, UL94V-0, UL945VB, or UL945VA in the order that the flame retardancy becomes higher, and UL94V-0, UL945VB, and UL945VA are regarded as pass.

TABLE 1

| | | Ex. 1 | Ex. 2 | Ex. 3 | Ex. 4 | Ex. 5 |
|---|---|---|---|---|---|---|
| Thermoplastic resin | KYNAR720 | 86 | 86 | 86 | 88 | 86 |
| Electroconductive inorganic particles | DENKA BLACK | 9 | 9 | 9 | 9 | 9 |
| Electroconductive resins | Electroconductive resin (1) | 5 | | | | |
| | Electroconductive resin (2) | | 5 | | | |
| | Electroconductive resin (3) | | | 5 | | |
| | Electroconductive resin (4) | | | | 3 | 5 |
| | Electroconductive resin (5) | | | | | |
| Molding conditions | Kneading speed (rpm) | 30 | 30 | 30 | 30 | 30 |
| Surface resistivity (Ω/sq.) | 10 V | $2.35\times10^{11}$ | $1.00\times10^{11}$ | $1.77\times10^{10}$ | $4.50\times10^{10}$ | $1.80\times10^{10}$ |
| | 500 V | $1.67\times10^{10}$ | $7.80\times10^{10}$ | $8.39\times10^{10}$ | $5.10\times10^{10}$ | $9.80\times10^{9}$ |
| Volume resistivity (Ω/cm) | 100 V | $8.70\times10^{10}$ | $9.10\times10^{9}$ | $1.33\times10^{9}$ | $1.00\times10^{9}$ | $8.30\times10^{8}$ |
| | 250 V | $3.60\times10^{9}$ | $7.70\times10^{8}$ | $9.18\times10^{8}$ | $4.30\times10^{10}$ | $2.20\times10^{8}$ |
| Localized state | | Localized | Localized | Localized | Localized | Localized |
| Minor axis b (μm) | | 0.6 | 0.8 | 4.2 | 2.1 | 3.9 |
| Rate α of the electroconductive resin in the cross-sectional surface (%) | | 2.9 | 2.9 | 10.5 | 9.2 | 10.0 |
| Rank of flame retardancy (according to the UL 94 Standard) | | V-0 | V-0 | V-0 | V-0 | V-0 |

TABLE 2

| | | Ex. 6 | Ex. 7 | Ex. 8 | Ex. 9 | Ex. 10 |
|---|---|---|---|---|---|---|
| Thermoplastic resin | SOLEF FLEX VISC. 10 | 86 | 86 | 86 | 88 | 86 |
| Electroconductive inorganic particles | DENKA BLACK | 9 | 9 | 9 | 9 | 9 |
| Electroconductive resins | Electroconductive resin (1) | 5 | | | | |
| | Electroconductive resin (2) | | 5 | | | |
| | Electroconductive resin (3) | | | 5 | | |
| | Electroconductive resin (4) | | | | 3 | 5 |
| | Electroconductive resin (5) | | | | | |
| Molding conditions | Kneading speed (rpm) | 30 | 30 | 30 | 30 | 30 |
| Surface resistivity (Ω/sq.) | 10 V | $4.90\times10^{11}$ | $8.70\times10^{11}$ | $6.60\times10^{10}$ | $3.20\times10^{11}$ | $2.10\times10^{10}$ |
| | 500 V | $9.70\times10^{9}$ | $3.30\times10^{11}$ | $9.99\times10^{8}$ | $6.80\times10^{10}$ | $1.18\times10^{10}$ |
| Volume resistivity (Ω/cm) | 100 V | $6.60\times10^{9}$ | $4.80\times10^{9}$ | $2.30\times10^{9}$ | $3.80\times10^{10}$ | $4.90\times10^{8}$ |
| | 250 V | $2.10\times10^{9}$ | $9.80\times10^{8}$ | $6.50\times10^{8}$ | $9.80\times10^{9}$ | $2.10\times10^{8}$ |
| Localized state | | Localized | Localized | Localized | Localized | Localized |
| Minor axis b (μm) | | 0.9 | 1.2 | 4.9 | 2.7 | 4.4 |
| Rate α of the electroconductive resin in the cross-sectional surface (%) | | 3.3 | 3.2 | 18.0 | 9.9 | 13.0 |
| Rank of flame retardancy (according to the UL 94 Standard) | | V-0 | V-0 | V-0 | V-0 | V-0 |

TABLE 3

| | | Ex. 11 | Ex. 12 | Ex. 13 | Ex. 14 | Ex. 15 |
|---|---|---|---|---|---|---|
| Thermoplastic resin | KYNAR720 | 86 | 86 | 86 | 88 | 86 |
| Electroconductive inorganic particles | DENKA BLACK | 9 | 9 | 9 | 9 | 9 |
| Electroconductive resins | Electroconductive resin (1) | 5 | | | | |
| | Electroconductive resin (2) | | 5 | | | |
| | Electroconductive resin (3) | | | 5 | | |
| | Electroconductive resin (4) | | | | 3 | 5 |
| | Electroconductive resin (5) | | | | | |
| Molding conditions | Kneading speed (rpm) | 15 | 15 | 15 | 15 | 15 |
| Surface resistivity (Ω/sq.) | 10 V | $2.35 \times 10^{11}$ | $1.00 \times 10^{12}$ | $1.77 \times 10^{10}$ | $4.50 \times 10^{10}$ | $1.80 \times 10^{10}$ |
| | 500 V | $1.67 \times 10^{11}$ | $7.80 \times 10^{11}$ | $8.39 \times 10^{10}$ | $5.10 \times 10^{10}$ | $9.80 \times 10^{9}$ |
| Volume resistivity (Ω/cm) | 100 V | $8.70 \times 10^{9}$ | $1.10 \times 10^{10}$ | $1.33 \times 10^{9}$ | $1.10 \times 10^{9}$ | $8.30 \times 10^{8}$ |
| | 250 V | $3.60 \times 10^{9}$ | $7.70 \times 10^{9}$ | $9.18 \times 10^{8}$ | $4.30 \times 10^{10}$ | $2.20 \times 10^{8}$ |
| Localized state | | Localized | Localized | Localized | Localized | Localized |
| Minor axis b (μm) | | 1.4 | 1.8 | 4.8 | 3.1 | 4.1 |
| Rate α of the electroconductive resin in the cross-sectional surface (%) | | 3.1 | 3.3 | 17.7 | 9.8 | 15.0 |
| Rank of flame retardancy (according to the UL 94 Standard) | | V-0 | V-0 | V-0 | V-0 | V-0 |

TABLE 4

| | | Ex. 16 | Ex. 17 | Ex. 18 | Ex. 19 | Ex. 20 | Ex. 21 | Ex. 22 |
|---|---|---|---|---|---|---|---|---|
| Thermoplastic resin | KYNAR720 | 81 | 81 | 81 | 85 | 81 | 91 | 91 |
| Electroconductive inorganic particles | DENKA BLACK | 9 | 9 | 9 | 9 | 9 | | 4 |
| | KETJEN BLACK | | | | | | 4 | |
| Electroconductive resins | Electroconductive resin (1) | 10 | | | | | 5 | |
| | Electroconductive resin (2) | | 10 | | | | | |
| | Electroconductive resin (3) | | | 10 | | | | |
| | Electroconductive resin (4) | | | | 6 | 10 | | |
| | Electroconductive resin (5) | | | | | | | 5 |
| Molding conditions | Kneading speed (rpm) | 15 | 15 | 15 | 15 | 15 | 30 | 30 |
| Surface resistivity (Ω/sq.) | 10 V | $5.54 \times 10^{12}$ | $1.64 \times 10^{13}$ | $2.67 \times 10^{12}$ | $5.50 \times 10^{10}$ | $4.40 \times 10^{9}$ | $3.84 \times 10^{11}$ | $4.48 \times 10^{12}$ |
| | 500 V | $4.87 \times 10^{11}$ | $6.81 \times 10^{11}$ | $5.23 \times 10^{11}$ | $3.20 \times 10^{10}$ | $7.80 \times 10^{8}$ | $8.80 \times 10^{10}$ | $2.97 \times 10^{10}$ |
| Volume resistivity (Ω/cm) | 100 V | $9.67 \times 10^{11}$ | $3.33 \times 10^{13}$ | $4.23 \times 10^{11}$ | $4.20 \times 10^{10}$ | $5.30 \times 10^{9}$ | $9.90 \times 10^{10}$ | $6.50 \times 10^{11}$ |
| | 250 V | $2.79 \times 10^{11}$ | $2.60 \times 10^{12}$ | $3.76 \times 10^{10}$ | $2.30 \times 10^{10}$ | $2.30 \times 10^{9}$ | $8.45 \times 10^{10}$ | $4.80 \times 10^{10}$ |
| Localized state | | Localized | Localized | Localized | Localized | Localized | Localized | Localized |
| Minor axis b (μm) | | 1.1 | 1.2 | 4.4 | 3.1 | 4.1 | 0.7 | 3.8 |
| Rate α of the electroconductive resin in the cross-sectional surface (%) | | 5.5 | 8.7 | 19.8 | 15.2 | 19.2 | 2.9 | 12.1 |
| Rank of flame retardancy (according to the UL 94 Standard) | | V-0 | V-0 | V-0 | V-0 | V-0 | V-0 | V-0 |

Comparative Example 1

Molding of Endless Intermediate Transfer Belt

An endless intermediate transfer belt having a thickness of 100 μm was molded in the same manner as in Example 1 except that the kneading speed of the resin pellets 1 and the electroconductive resin (1) was changed to 8 rpm.

Comparative Example 2

Molding of Endless Intermediate Transfer Belt

An endless intermediate transfer belt having a thickness of 100 μm was molded in the same manner as in Example 1 except that the kneading speed of the resin pellets 1 and the electroconductive resin (1) was changed to 50 rpm.

Comparative Example 3

Molding of Endless Intermediate Transfer Belt

An endless intermediate transfer belt having a thickness of 100 μm was molded in the same manner as in Example 1 except that the electroconductive resin (1) was changed to a polyamide electroconductive resin having a different SP value (MC500AS R11, product of QUADRANT POLYPENCO JAPAN LTD., melting point: 212° C.) and that the temperature of the cylinder having the side feeder was changed to 250° C. and the temperature of the circular die was changed to 235° C.

Comparative Example 4

Molding of Endless Intermediate Transfer Belt

An endless intermediate transfer belt having a thickness of 100 μm was molded in the same manner as in Example 1 except that the amount of the electroconductive resin (1) added was changed to 25% by mass.

Comparative Example 5

Molding of Endless Intermediate Transfer Belt

An endless intermediate transfer belt having a thickness of 100 μm was molded in the same manner as in Example 1 except that the electroconductive resin (1) was not added.

Comparative Example 6

Molding of Endless Intermediate Transfer Belt

An endless intermediate transfer belt having a thickness of 100 μm was molded in the same manner as in Example 1 except that the amount of the electroconductive resin (1) added was changed to 1% by mass.

Comparative Example 7

Molding of Endless Intermediate Transfer Belt

An endless intermediate transfer belt having a thickness of 100 μm was molded in the same manner as in Example 1 except that the electroconductive resin (1) was changed to the electroconductive resin (3) and the amount thereof was changed to 2% by mass.

Comparative Example 8

Molding of Endless Intermediate Transfer Belt

An endless intermediate transfer belt having a thickness of 100 μm was molded in the same manner as in Example 1 except that the amount of the electroconductive resin (1) added was changed to 2% by mass.

Comparative Example 9

Molding of Endless Intermediate Transfer Belt

An endless intermediate transfer belt having a thickness of 100 μm was molded in the same manner as in Example 1 except that the electroconductive resin (1) was changed to the electroconductive resin (3) and the amount thereof was changed to 10% by mass.

Comparative Example 10

Molding of Endless Intermediate Transfer Belt

An endless intermediate transfer belt having a thickness of 100 μm was molded in the same manner except that amount of the electroconductive resin (1) added was changed to 10% by mass.

Various properties of each of the endless intermediate transfer belts of the above Comparative Examples were evaluated in the same manner as in the Examples. The results were collectively shown in Tables 5-1 and 5-2. The units of the numerical values in the columns for the materials in the tables are % by mass.

As shown in Table 5-1, the endless intermediate transfer belts of Comparative Examples 1 to 3 are regarded as fail in electrical properties, since the kneading speed in Comparative Example 1 was too slow, the kneading speed in Comparative Example 2 was too high, and the difference in SP value between the thermoplastic resin and the electroconductive resin in Comparative Example 3 is too small.

TABLE 5-1

| | | Comp. Ex. 1 | Comp. Ex. 2 | Comp. Ex. 3 | Comp. Ex. 4 | Comp. Ex. 5 |
|---|---|---|---|---|---|---|
| Thermoplastic resin | KYNAR720 | 86 | 86 | 86 | 68 | 91 |
| Electroconductive inorganic particles | DENKA BLACK | 9 | 9 | 9 | 7 | 9 |
| Electroconductive resin | Electroconductive resin (1) | 5 | 5 | | 25 | |
| | Electroconductive resin (3) MC500AS, product of QUADRANT POLYPENCO JAPAN LTD. | | | 5 | | |
| Molding conditions | Kneading speed (rpm) | 8 | 50 | 30 | 30 | 30 |
| Surface resistivity (Ω/sq.) | 10 V | OVER | OVER | OVER | $7.76 \times 10^{7}$ | OVER |
| | 500 V | OVER | OVER | OVER | UNDER | $8.50 \times 10^{13}$ |
| Volume resistivity (Ω/cm) | 100 V | OVER | OVER | OVER | $8.44 \times 10^{8}$ | $3.80 \times 10^{10}$ |
| | 250 V | OVER | OVER | OVER | $2.18 \times 10^{8}$ | $1.50 \times 10^{9}$ |
| | Localized state | Localized | Homogeneously dispersed | Homogeneously dispersed | Localized | Localized |
| | Minor axis b (μm) | 8.8 | — | — | 5.6 | Electroconductive resin was not added. |
| | Rate α of the electroconductive resin in the cross-sectional surface (%) | 11.2 | — | — | 28.2 | Electroconductive resin was not added. |
| | Rank of flame retardancy (according to the UL 94 Standard) | V-0 | V-0 | V-0 | V-2 | V-0 |

TABLE 5-2

| | | Comp. Ex. 6 | Comp. Ex. 7 | Comp. Ex. 8 | Comp. Ex. 9 | Comp. Ex. 10 |
|---|---|---|---|---|---|---|
| Thermoplastic resin | KYNAR720 | 90 | 89 | 89 | 81 | 81 |
| Electroconductive inorganic particles | DENKA BLACK | 9 | 9 | 9 | 9 | 9 |
| Electroconductive resin | Electroconductive resin (1) | 1 | | 2 | | 10 |
| | Electroconductive resin (3) MC500AS, | | 2 | | 10 | |

TABLE 5-2-continued

| | | Comp. Ex. 6 | Comp. Ex. 7 | Comp. Ex. 8 | Comp. Ex. 9 | Comp. Ex. 10 |
|---|---|---|---|---|---|---|
| | product of QUADRANT POLYPENCO JAPAN LTD. | | | | | |
| Molding conditions | Kneading speed (rpm) | 30 | 30 | 30 | 30 | 30 |
| Surface resistivity (Ω/sq.) | 10 V | OVER | OVER | OVER | $7.57 \times 10^{8}$ | $4.47 \times 10^{8}$ |
| | 500 V | $4.49 \times 10^{13}$ | $5.19 \times 10^{13}$ | OVER | UNDER | UNDER |
| Volume resistivity (Ω/cm) | 100 V | $3.82 \times 10^{14}$ | $2.23 \times 10^{13}$ | OVER | $9.88 \times 10^{8}$ | $3.32 \times 10^{8}$ |
| | 250 V | $5.56 \times 10^{13}$ | $1.01 \times 10^{13}$ | OVER | $8.23 \times 10^{8}$ | UNDER |
| Localized state | | Localized | Localized | Localized | Localized | Localized |
| Minor axis b (μm) | | 0.3 | 0.3 | 0.5 | 4.7 | 6.2 |
| Rate α of the electroconductive resin in the cross-sectional surface (%) | | 0.9 | 2.2 | 1.9 | 23.1 | 19.8 |
| Rank of flame retardancy (according to the UL 94 Standard) | | V-0 | V-0 | V-0 | V-0 | V-0 |

This application claims priority to Japanese application No. 2013-191052, filed on Sep. 13, 2013 and incorporated herein by reference.

What is claimed is:

1. An intermediate transfer member, comprising:

a layer containing a thermoplastic resin, an electroconductive resin, and electroconductive inorganic particles, wherein the electroconductive resin is a polymer containing a polyether unit, wherein the electroconductive inorganic particles include carbon black, wherein the layer has a sea-island structure where discontinuous phases formed from the electroconductive resin are present in a continuous phase formed from the thermoplastic resin, wherein in a cross-sectional surface of the layer perpendicular to a rotation direction of the intermediate transfer member, the discontinuous phases formed from the electroconductive resin each have a cross-sectional shape of an ellipse, and a minor axis b of the ellipse is from 0.5 μm to 5.0 μm, and wherein in the cross-sectional surface of the layer perpendicular to the rotation direction of the intermediate transfer member, a rate α of a total area of the discontinuous phases formed from the electroconductive resin in an area of the cross-sectional surface of the layer perpendicular to the rotation direction of the intermediate transfer member is from 2.0% to 20.0%.

2. An image forming apparatus, comprising:

an electrostatic latent image forming unit configured to form an electrostatic latent image on an image bearing member;

a developing unit configured to turn the electrostatic latent image on the image bearing member into a toner image;

a primary transfer unit configured to transfer the toner image on the image bearing member onto an intermediate transfer member;

a secondary transfer unit configured to transfer the primarily transferred toner image onto a recording medium; and a fixing unit configured to fix the secondarily transferred toner image, wherein the intermediate transfer member is the intermediate transfer member according to claim 1.

3. The intermediate transfer member according to claim 1, wherein a difference in solubility parameter (SP value) between the thermoplastic resin and the electroconductive resin is 2.5 or more.

4. The intermediate transfer member according to claim 1, wherein a surface resistivity (ρS) of the intermediate transfer member satisfies the following condition: $8 \leq \log(\rho S) \leq 13$.

5. The intermediate transfer member according to claim 1, wherein a difference in solubility parameter (SP value) between the thermoplastic resin and the electroconductive resin is 2.5 or more, and a surface resistivity (ρS) of the intermediate transfer member satisfies the following condition: $8 \leq \log(\rho S) \leq 13$.

6. The intermediate transfer member according to claim 1, wherein the layer containing a thermoplastic resin, an electroconductive resin, and electroconductive inorganic particles is a top-most layer of the intermediate transfer member.

* * * * *